US006652297B1

(12) United States Patent
Zhang et al.

(10) Patent No.: US 6,652,297 B1
(45) Date of Patent: Nov. 25, 2003

(54) CONNECTOR COVERING ASSEMBLY

(75) Inventors: Guang-Yi Zhang, Shenzhen (CN); Li-Yuan Gan, Shenzhen (CN); Lu-Sheng Li, Shenzhen (CN); Wen-Bin Liu, Shenzhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/413,895

(22) Filed: Apr. 14, 2003

(30) Foreign Application Priority Data

Jul. 4, 2002 (TW) ..... 91210186 U

(51) Int. Cl.[7] ..... H01R 13/44
(52) U.S. Cl. ..... 439/136; 439/135; 361/686
(58) Field of Search ..... 439/135, 136, 439/367, 521; 361/686, 754, 740

(56) References Cited

U.S. PATENT DOCUMENTS 4,607,136 A * 8/1986 Thomas ..... 439/136
4,914,265 A * 4/1990 Mongeau ..... 439/136
4,957,831 A * 9/1990 Meredith et al. ..... 439/500
5,067,907 A * 11/1991 Shotey ..... 439/135
5,199,888 A * 4/1993 Condra et al. ..... 439/136
5,722,748 A 3/1998 Lajara et al.
5,924,878 A * 7/1999 Lan et al. ..... 439/136

* cited by examiner

*Primary Examiner*—Tho D. Ta
(74) *Attorney, Agent, or Firm*—Wei Te Chung

(57) ABSTRACT

A connector covering assembly includes a cover (20), and a base (30) slidably supporting the cover thereon. The cover includes first and second sliding members (23, 25), and a raised shield (24) having a handle (26) thereon. A half portion of the base defines a plurality of openings (31) for receipt of connectors therethrough. An opposite half portion of the base forms a pair of symmetrical elastic members (33, 34). Longitudinal, slightly raised edges of the base generally at opposite sides of the openings and of the elastic members respectively define a first slideway (32) and a second slideway (36). The covering assembly is mounted to the back of a bezel (10) of a computer, with the cover slidably disposed between the base and the bezel.

13 Claims, 5 Drawing Sheets

CONNECTOR COVERING ASSEMBLY

BACKGROUND OF THE INVENTION

1. Field of the Invention

The present invention relates to covering devices, and particularly to a connector covering assembly for computer or other electronic devices.

2. Related Art

Various electrical connectors are installed in computers or other electronic devices at input/output (I/O) interfaces thereof, for electronic communication and handling of data. I/O interfaces are often mounted to bezels of computers, for conveniently providing housing for connectors such as USB ports thereat.

When I/O interfaces are mounted to a bezel of a computer, the bezel typically defines a recessed portion receiving connectors thereat. A shield covers the recessed portion for protection and aesthetic purposes, the shield being rotatably connected to the bezel at one side of the recessed portion. In use, the shield is rotated away to expose the connectors in the I/O interfaces for communication and handling of data. Generally, the bezel is further provided with a plurality of computer control buttons. The control buttons are usually arranged in the recessed portion, to avoid damage thereto that might otherwise result from movement of the cover.

When the I/O interfaces are in use, the shield is in an outwardly rotated position. Because the shield protrudes out from the bezel, it can be easily damaged, and it also causes inconvenience for users. In addition, the exposed I/O interfaces can be rather unsightly.

SUMMARY OF THE INVENTION

Accordingly, an object of the present invention is to provide a connector covering assembly which conveniently and readily covers I/O interfaces inside a computer or other electronic device.

To achieve the above-mentioned object, a connector covering assembly of the present invention is mounted to the back of a bezel of a computer or other electronic device. The connector covering assembly comprises a cover, and a base slidablely receiving the cover thereon. The cover comprises a pair of first sliding members, a second sliding member, and a raised shield having a handle thereon. A half portion of the base defines a plurality of openings, for receipt of connectors therethrough. An opposite half portion of the base forms a pair of symmetrically elastic members. Longitudinal, slightly raised edges of the base generally at opposite sides of the openings and of the elastic members respectively form a first slideway and a second slideway. The assembled cover and base are mounted to the back of the bezel, with the cover slidably disposed between the base and the bezel.

Other objects, advantages and novel features of the present invention will be drawn from the following detailed description of preferred embodiments of the present invention with the attached drawings, in which:

DESCRIPTION OF THE PREFERRED EMBODIMENTS

Figure 1:
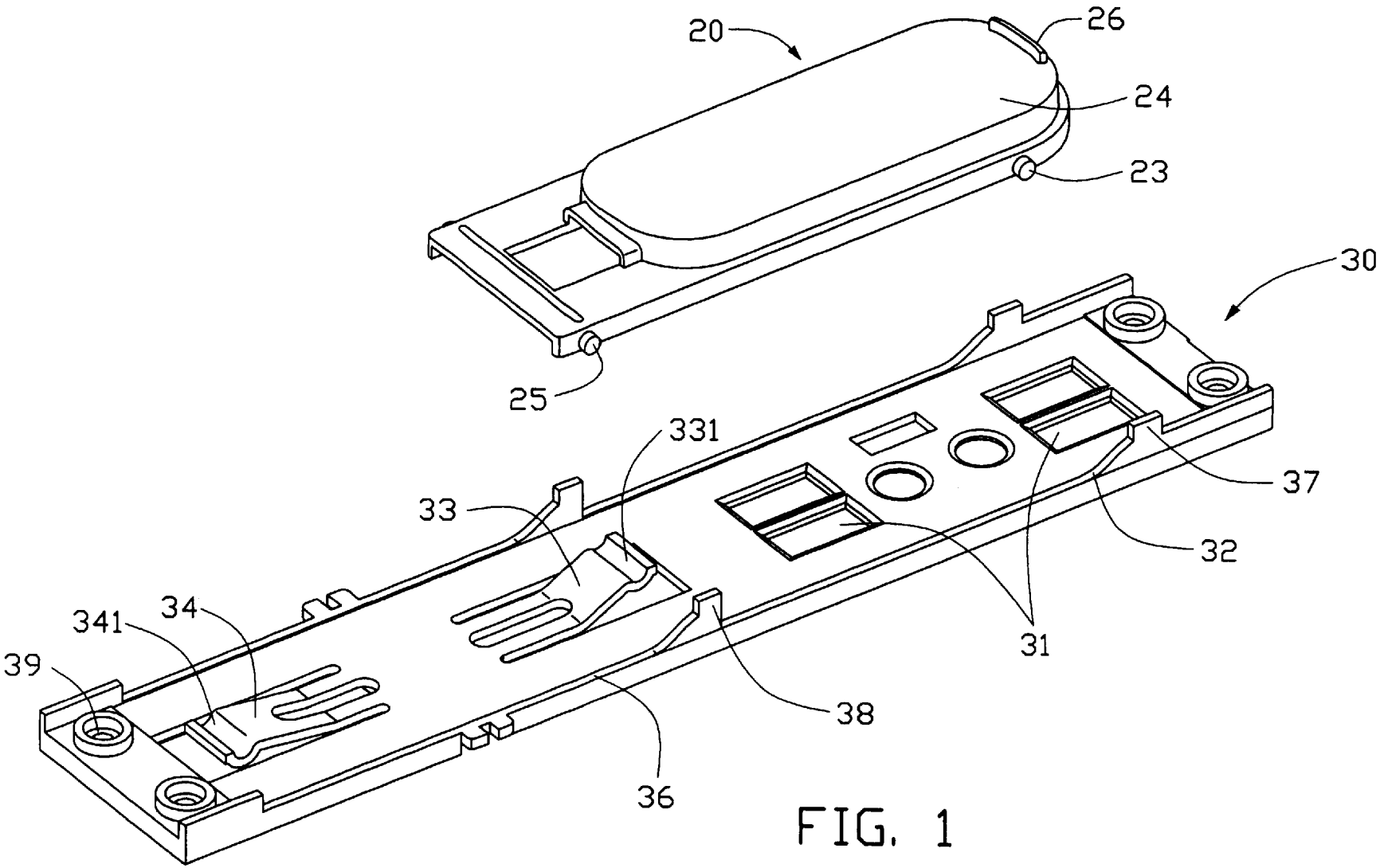
FIG. 1 is an exploded, isometric view of a connector covering assembly in accordance with the present invention.
Figure 2:
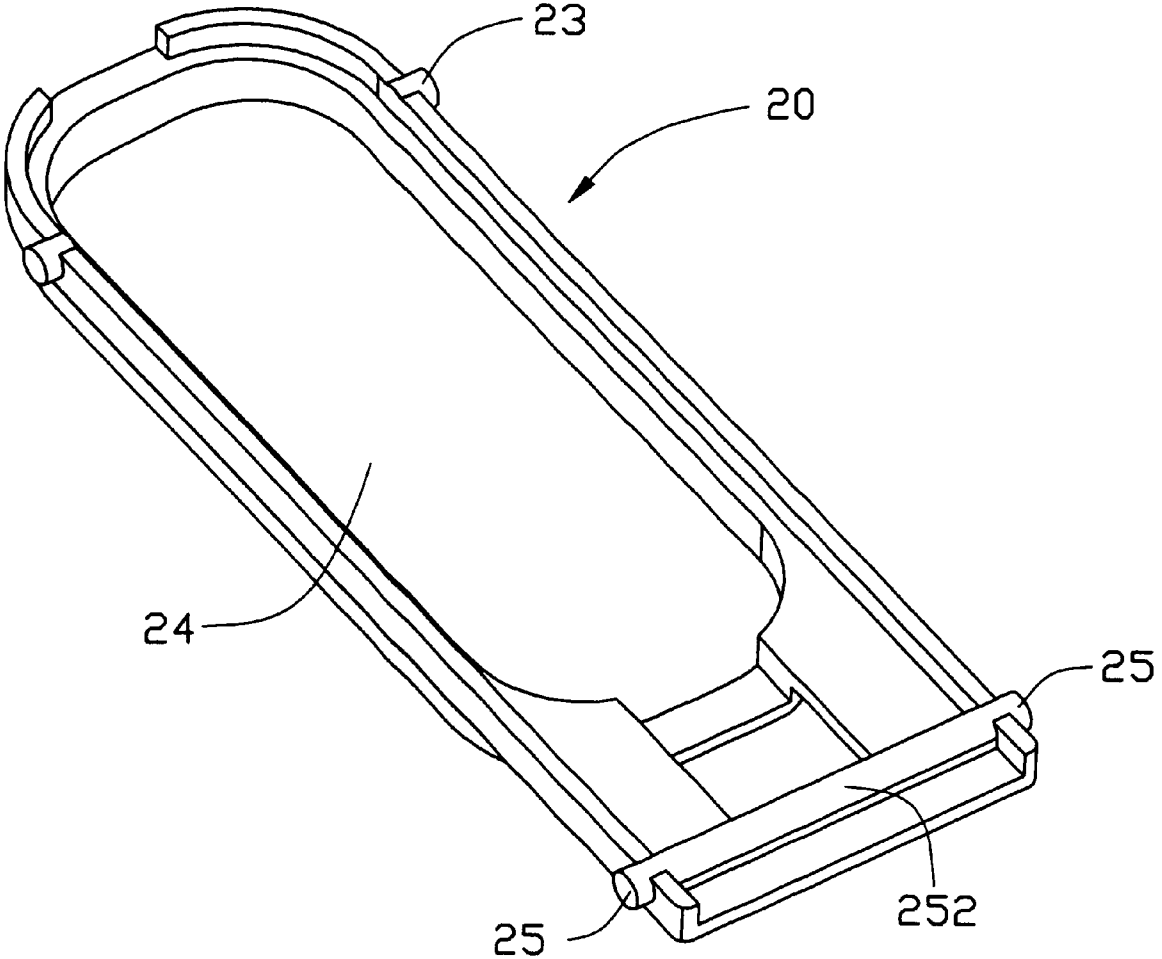
FIG. 2 is an enlarged view of a cover of the covering assembly of FIG. 1, but viewed from another aspect.
Figure 3:
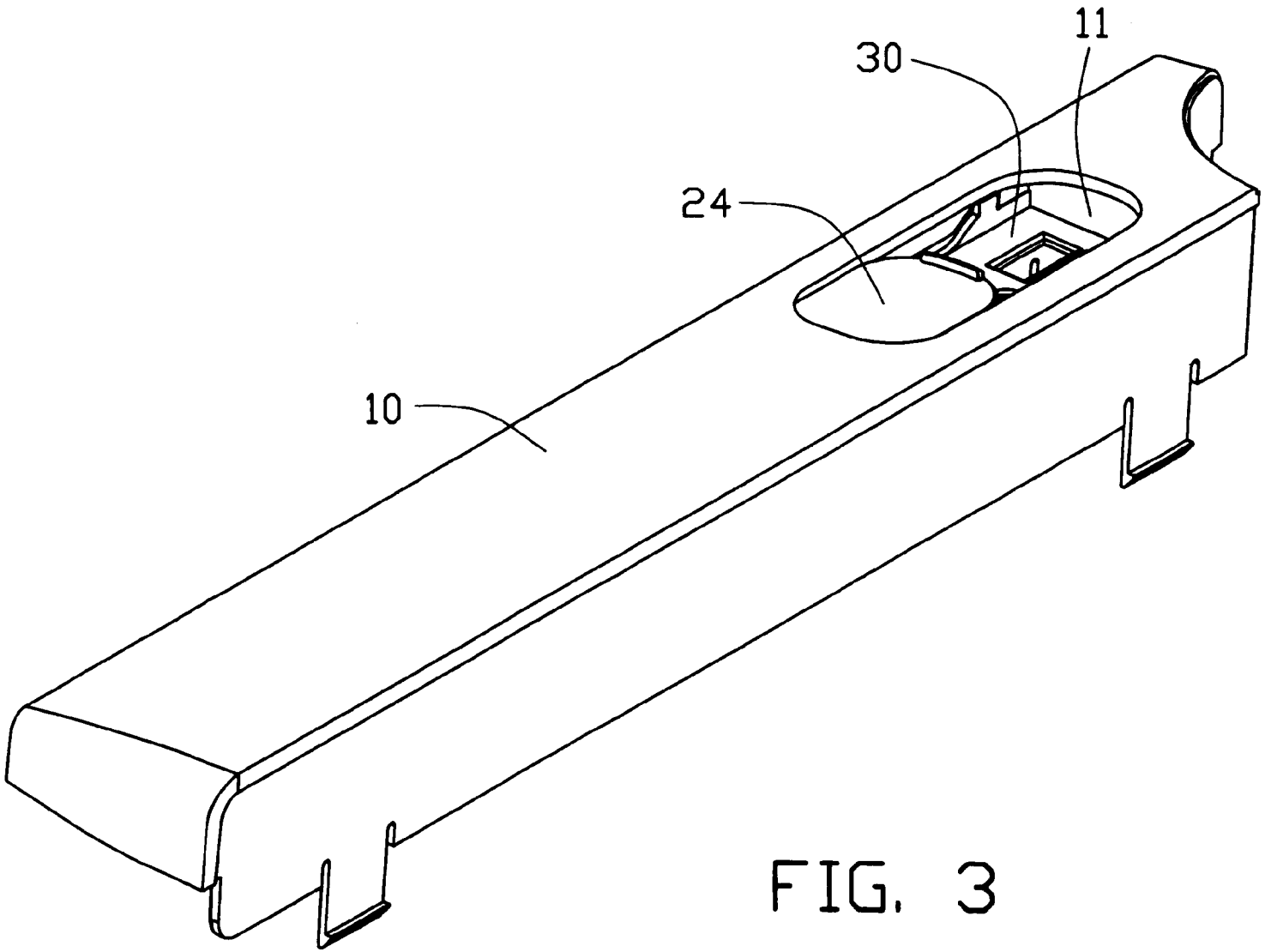
FIG. 3 is an isometric view of the covering assembly of FIG. 1 fully assembled and attached to a bezel.

Referring to FIGS. 1–3, a connector covering assembly in accordance with the present invention is for attachment to a bezel 10 of an electronic device such as a computer. The covering assembly covers I/O interfaces inside the computer. The covering assembly comprises a base 30, and a cover 20 slidably mounted on the base 30.

The cover 20 forms a pair of opposite first sliding members 23 at an end thereof. A rod-shaped second sliding member 25 is transversely formed at an opposite end of the cover 20, the second sliding member 25 spanning a full width of the cover 20. The second sliding member 25 is parallel to an axis defined by the first sliding members 23. The second sliding member 25 defines a medial locating part 252. In an alternative embodiment of the present invention, the locating part 252 and remaining parts of the second sliding member 25 may be separately formed. The cover 20 forms a raised shield 24. The shield 24 is provided with a handle 26 disposed generally between the first sliding members 23.

The base 30 is generally a longitudinal rectangular board. An end half portion of the base 30 defines a plurality of openings 31, for receipt of connectors therethrough. Longitudinal, slightly raised edges of the base 30 generally at opposite sides of the openings 31 cooperatively form a first longitudinal slideway 32. An opposite end half portion of the base 30 forms a first elastic member 33 and a second elastic member 34. The first and second elastic members 33, 34 are symmetrical with each other. The first and second elastic members 33, 34 extend slantwisedly slightly upwardly from the base 30. The first elastic member 33 defines a first locating recess 331, and the second elastic member 34 defines a second locating recess 341. Longitudinal, slightly raised edges of the base 30 generally at opposite sides of the first and second elastic members 33, 34 cooperatively form a second longitudinal slideway 36. The first and second slideways 32, 36 have similar configurations, each comprising an elongate horizontal portion and a raised portion connecting with the horizontal portion. The raised portions of the first and second slideways 32, 36 are respectively defined by blocks 37, 38. The base 30 defines a pair of fixing holes 39 at each of opposite ends thereof, for mounting the base 30 to the bezel 10 of the computer.

The bezel 10 defines a window 11 for exposure of the openings 31. Two pairs of locating columns (not shown) extending from opposite ends of the bezel 10 are engaged in the fixing holes 39 of the base 30.

In assembly, the cover 20 is mounted to the base 30. The first sliding members 23 of the cover 20 engage on the first slideway 32, and the second sliding member 25 of the cover 20 engages on the second slideway 36. The handle 26 on the shield 24 is pushed to cause the cover 20 to slide along the first and second slideways 32, 36 so that the locating part 252 of the second sliding member 25 enters either locating recess 331, 341 of the elastic portions 33, 34. Thereupon, the cover 20 is prevented from being moved accidentally. Then the combined base 30 and cover 20 is mounted to the back of the bezel 10, with the locating columns of the bezel 10 engaging in the fixing holes 39 of the base 30. The openings 31 for connectors are located behind the window 11 of the bezel 10.

Figure 4:
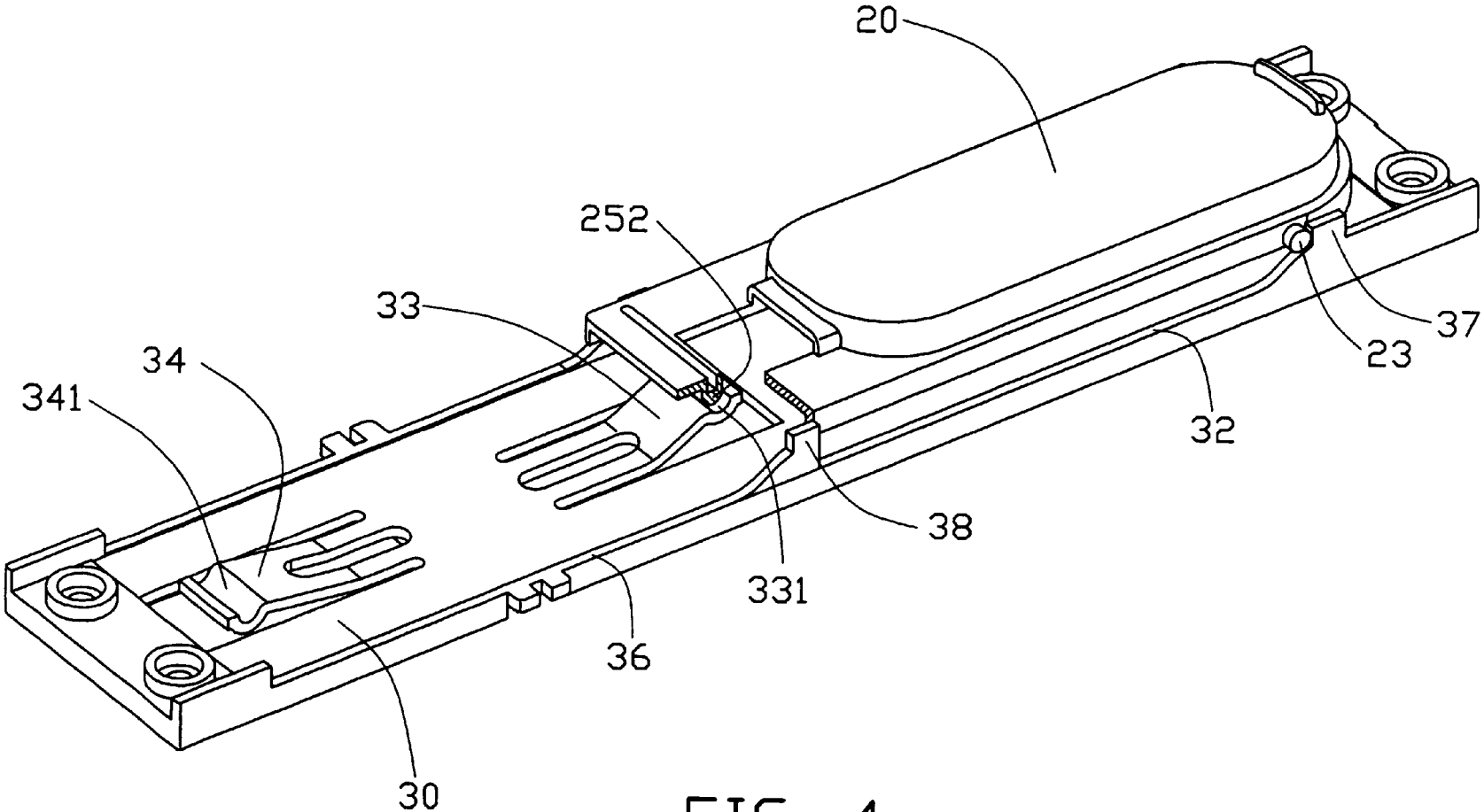
FIG. 4 is an assembled view of FIG. 1, partly cut away.

Referring to FIG. 4, when connectors are not used, the cover 20 is slid to the first slideway 32 of the base 30 so that it covers the openings 31 of the base 30. In this process, the first sliding members 23 are stopped by the blocks 37 of the base 30 from being slid too far, and the locating part 252 of the second sliding member 25 of the cover 20 is received in the recess 331. Thus the cover 20 is securely held in position.

Figure 5:
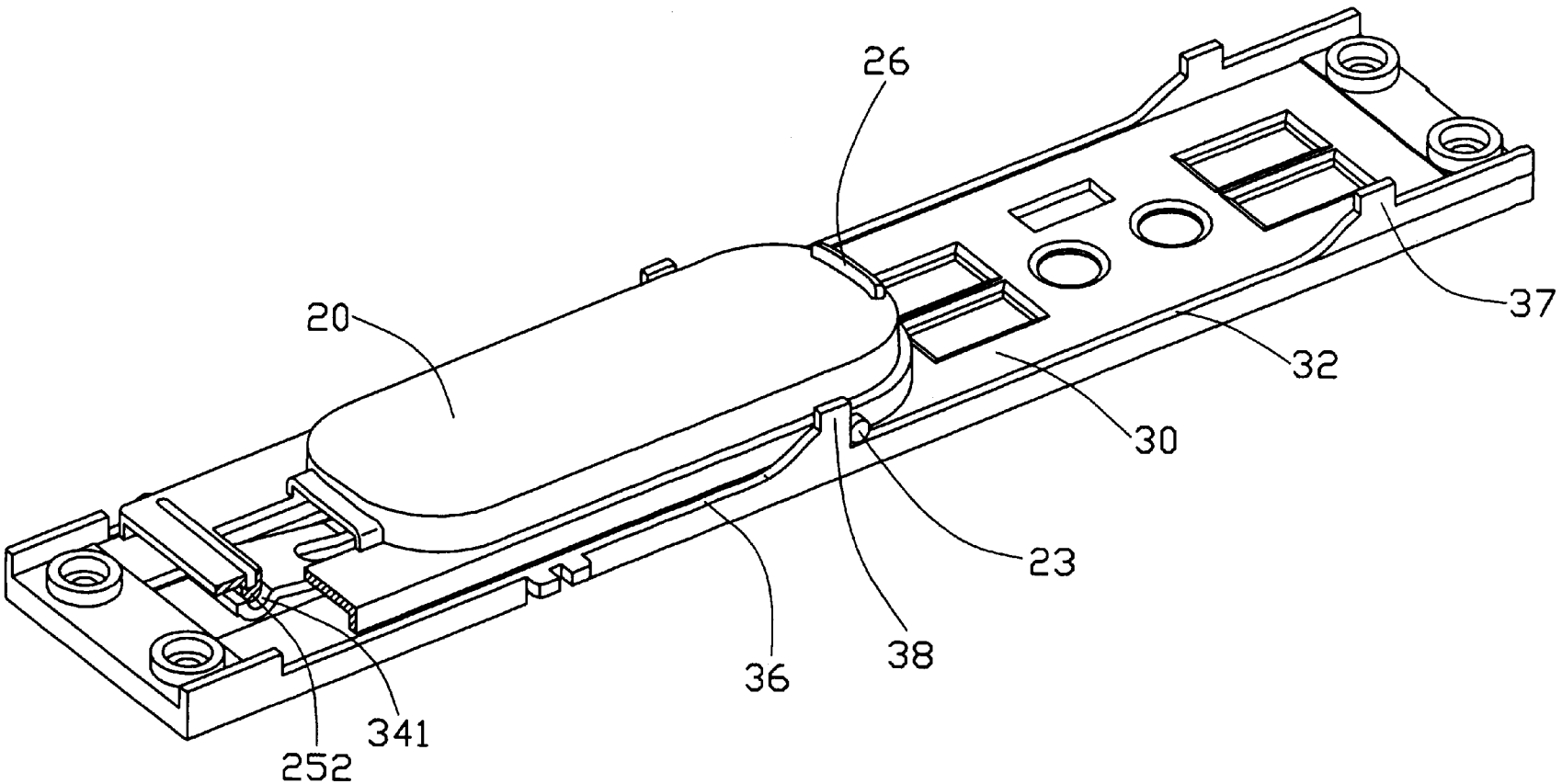
FIG. 5 is similar to FIG. 4, but showing the cover slid to a different position.

Referring also to FIG. 5, when connectors are used, the handle 26 of the cover 20 is pushed. The locating part 252 of the second sliding member 25 presses the first elastic portion 33 downwardly and releases the cover 20 from the locating recess 331. Then the first and second sliding members 23, 25 of the cover 20 are slid along the first and the second slideways 32, 36, and the cover 20 is gradually hidden behind the bezel leaving the openings 31 of the base 30 exposed. In this process, the locating part 252 presses the second elastic member 34 downwardly, and thereafter slides into the recess 341. The first sliding members 23 are stopped by the blocks 38 of the base 30 from being slid too far. Thus the cover 20 is securely received at the second glideway 36, leaving the window 11 of the bezel 10 open. When the window 11 is to be closed, the handle 26 of the cover 20 is pushed, and the cover 20 is slid to the first slideway 32 as described above.

It is understood that the invention may be embodied in other forms without departing from the spirit thereof. Thus, the present example and embodiment are to be considered in all respects as illustrative and not restrictive, and the invention is not to be limited to the details given herein.

What is claimed is:

1. A covering assembly adapted to be mounted to a bezel of an electronic device, the bezel defining a window, the covering assembly comprising;

a cover comprising a raised shield, a pair of first sliding members, and second sliding members; and a base supporting the cover thereon in communication with the window, a half portion of the base defining a plurality of openings for receipt of connectors therethrough, an opposite half portion of the base forming a pair of symmetrical elastic members to securely hold the cover on the base, raised edge portions of the base at opposite sides of the openings and of the elastic members respectively defining a first slideway and a second slideway;

wherein the first and second sliding members of the cover can slide along the first and second slideways respectively to cause the cover to cover or uncover the window of the bezel.

2. The covering assembly as claimed in claim 1, wherein the shield is provided with a handle near the first sliding members.

3. The covering assembly as claimed in claim 1, wherein each of the first and second sliding members of the cover are rod-shaped, and the second sliding member is parallel to the first sliding members.

4. The covering assembly as claimed in claim 1, wherein the first and second slideways each comprise an elongate portion and an end block.

5. The covering assembly as claimed in claim 1, wherein the base further defines a plurality of fixing holes, for mounting of the covering assembly to the bezel.

6. The covering assembly as claimed in claim 1, wherein each of the elastic members defines a locating recess in end portion thereof and the cover comprises a medial locating part received in a corresponding recess to allow the cover to cover or uncover the window of the bezel.

7. The covering assembly as claimed in claim 6, wherein each of the elastic members extends slantwisedly slightly upwardly from the base.

8. The covering assembly as claimed in claim 6, wherein the medial locating part can be integrally formed with the second sliding members.

9. The covering assembly as claimed in claim 6, wherein the cover comprises a pair of aligned second sliding members, and a medial locating part located between and offseting from the second sliding members.

10. A covering assembly comprising:

a bezel defining a large opening;

a stationary base and a moveable cover, as said base located behind the bezel to cooperate with the bezel to at least partially sandwich the cover therebetween;

a plurality of connection or switching ports formed in said base in alignement with said opening in a front-to-back direction;

sliding means formed on both said base and said cover for allowing said cover to be able to move relative to the base in both a lengthwise direction along the base and the front-to-back direction; wherein relisient means formed on at least one of said base and said cover to urge the cover to be generally coplanar with the bezel when said cover is moved to a position covering said opening.

11. The assembly as claimed in claim 10, wherein said lengthwise direction is perpendicular to said front-to-back direction.

12. A covering assembly comprising:

a bezel defining a large opening;

a stationary base and a moveable cover, said base located behind the bezel;

a plurality of connection or switching ports formed in said base in alignement with said opening in a front-to-back direction;

said base defining a slide way along a lengthwise direction thereof, the cover defining a slide member engageably moveable along the slide way to back or forth cover or expose the opening; and resilience means formed on the base and cooperating with the slide way to urge the cover toward the bezel along said front-to-back direction.

13. The assembly as claimed in claim 12, wherein said lengthwise direction is perpendicular to said front-to-back direction.

* * * * *